United States Patent [19]

Gordon

[11] 4,330,691

[45] May 18, 1982

[54] INTEGRAL CEILING TILE-LOUDSPEAKER SYSTEM

[75] Inventor: Theodore J. Gordon, Glastonbury, Conn.

[73] Assignee: The Futures Group, Inc., Glastonbury, Conn.

[21] Appl. No.: 117,056

[22] Filed: Jan. 31, 1980

[51] Int. Cl.[3] ..... H04R 3/12; H04R 27/00

[52] U.S. Cl. ..... 179/146 E; 179/1 AT; 181/144

[58] Field of Search ..... 179/146 E, 1 E, 111 R, 179/115.5 PS, 1 AT; 181/150, 145, 144

[56] References Cited

U.S. PATENT DOCUMENTS 3,008,013 11/1961 Williamson et al. ..... 179/111 R 3,135,838 6/1964 Wright ..... 179/111 R 4,057,689 11/1977 Stallings, Jr. ..... 179/1 E

*Primary Examiner*—Thomas W. Brown

*Attorney, Agent, or Firm*—Hayes & Reinsmith

[57] ABSTRACT

A loudspeaker is formed integrally with a rectangular ceiling tile which is provided with electrical contacts for connecting the loudspeaker in series or parallel combinations with other loudspeaker-tile assemblies and for supplying power to the loudspeaker from a bus, such as the T-bar which supports the ceiling tile in a typical suspended ceiling installation. A plurality of these loudspeaker-tile assemblies can be used as part of either the ceiling or wall of a large room into which sound is to be transmitted. The loudspeakers are completely concealed from view. Different electrical delay lines can be connected to various speakers in the array of speakers to produce desired acoustical effects.

15 Claims, 18 Drawing Figures

FIG. 1
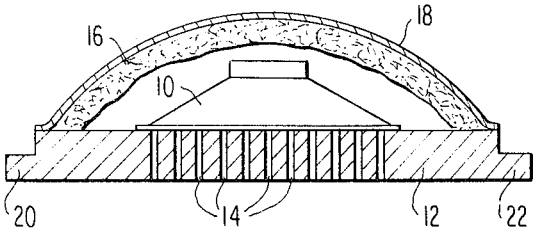
FIG. 2
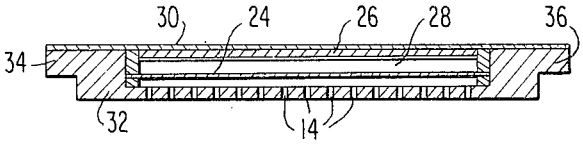
FIG. 3
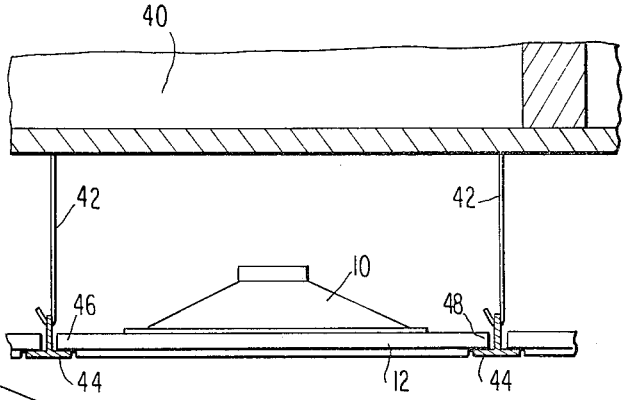
FIG. 4
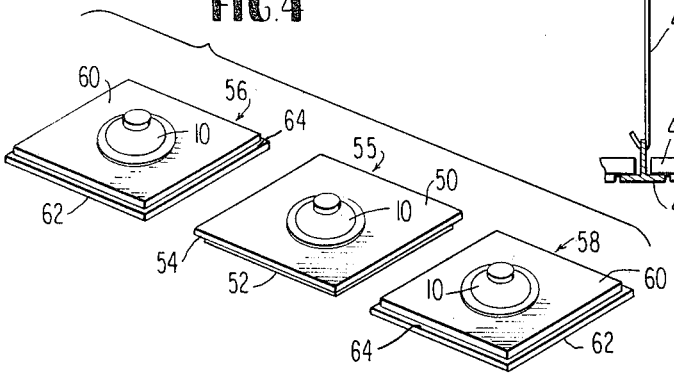
FIG. 5
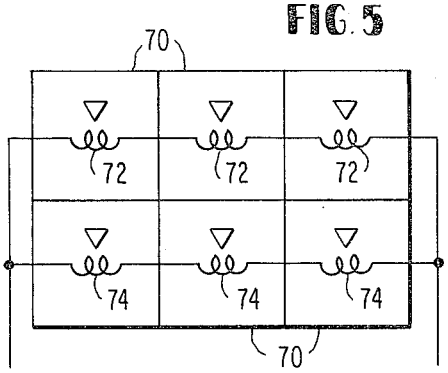
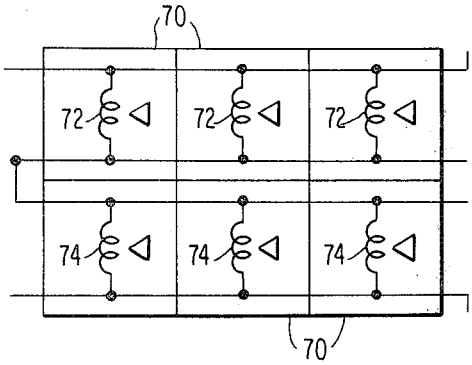
FIG. 6
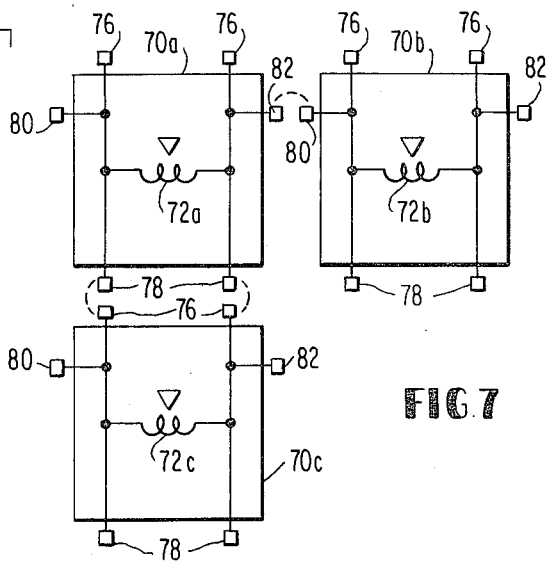
FIG. 7
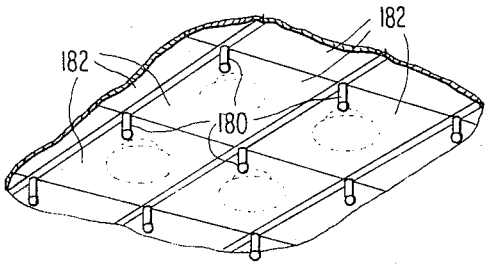
FIG. 15

INTEGRAL CEILING TILE-LOUDSPEAKER SYSTEM

BACKGROUND OF THE INVENTION

1. Field of the Invention

This invention relates generally to the field of loud speakers and, more particularly, to a novel celing tile-loudspeaker assembly or unit and a loudspeaker array or system employing the same.

2. Description of the Prior Art

Conventionally, large loudspeakers have been used as "point" sources of sound to achieve a desired sound level pressure or volume in a large room. The excursion of the active element in such large loudspeakers used as point sources is proportionately large and, thereby, inherently produces sound distortion. Furthermore, the installation of such loudspeakers in arrays employing as many as a hundred or more loudspeakers is costly and time-consuming, since each speaker must be individually mounted and electrically interconnected to adjacent speakers.

OBJECT OF THE INVENTION

Thus, it is a general object of this invention to provide an improved loudspeaker unit or assembly which is particularly suitable for use in an array of loudspeakers mounted in a ceiling or a wall of a room.

Another object of the invention is to provide an integral ceiling tile-loudspeaker assembly which can be quickly and easily installed.

Still another object of the invention is to provide such an assembly in which the electrical connections to the loudspeaker are made through electrical contacts formed on the tile.

Still another object of the invention is to provide such an assembly in which the electrical contacts on the tile cooperate with similar contacts on other tiles to provide desired series and parallel connections of a plurality of loudspeakers.

Another object of the invention is to supply electrical signals to the speakers via the electrical contacts and the ceiling tile supporting structure.

Another object of the invention is to provide an array of loudspeakers in which each individual loudspeaker has a smaller active element than a larger loudspeaker used as a point source.

Another object of the invention is to provide different time delays in various ones of the loudspeakers in an array so that the sound from various loudspeakers in the array arrive at a listening area at essentially the same time.

A further object of the invention is to provide a ceiling tile having a lamp therein which emits light whose intensity varies in accordance with the electrical signals applied to loud speakers in the array.

BRIEF DESCRIPTION OF THE DRAWINGS

FIG. 1 is a cross-sectional view of an integrated ceiling tile-loudspeaker unit employing a magnetic loudspeaker.

FIG. 2 is a cross-sectional view of an integrated celing tile-loudspeaker unit employing an electrostatic loudspeaker.

FIG. 3 illustrates the manner in which the integrated ceiling tile-loudspeaker unit or assembly is supported by a suspended ceiling structure.

FIG. 4 illustrates the manner in which adjacent loudspeaker-tile units or assemblies can be interlocked and fitted together.

FIGS. 5 and 6 are schematic diagrams illustrating the manner in which the loudspeakers in an array can be interconnected in various series-parallel combinations.

FIG. 7 illustrates the manner in which the terminals are arranged on a tile in order to provide selective series and parallel interconnections of adjacent loudspeakers in an array.

FIG. 15 illustrates the manner in which the speaker tile assemblies are used in an array to produce noise-masking.

DETAILED DESCRIPTION OF THE PREFERRED EMBODIMENTS

Figure 8A:
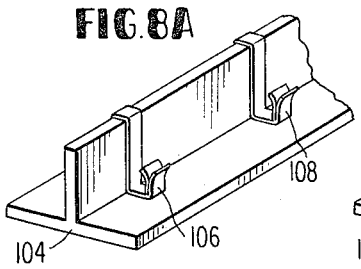
FIGS. 8A, 8B and 8C illustrate the manner in which electrical contacts can be formed on a supporting T-bar for supplying electrical signals to the loudspeaker-tile assemblies.

FIGS. 1 and 2 illustrate the basic unitary or integral ceiling tile-loudspeaker assembly of this invention. In both FIGS. 1 and 2, loudspeakers are mounted in tiles resembling acoustical ceiling tiles which can be integrated into a ceiling or wall to form an array of loudspeakers having relatively small and distortionless active elements.

In FIG. 1, loudspeaker 10 is of the magnetic type and is mounted on the back or concealed surface of a ceiling tile 12 having sound-transmitting perforations 14 extending from the rear to front surface thereof in the area covered by the loudspeaker 10. Sound absorption material 16 is disposed between the rear of the loudspeaker 10 and the enclosure dome 18. The rectangular tile 12 has shoulders 20 and 22 extending from the front surface of the tile.

FIG. 2 illustrates a loudspeaker/tile assembly in which the loudspeaker is of the electrostatic type. The active element 24 and the charge surface 26 are separated by a dielectric 28, e.g., air. The entire speaker assembly is enclosed by a rear surface 30 having low sound transmissibility. The tile 32 also has the perforations 14. In this case the tile has shoulders 34 and 36 extending from the rear surface of the tile, thereby permitting such a tile to be interlocked or meshed with the complementary shoulders 20, 22 formed on the rear surface of a tile, such as the tile 12 in FIG. 1. The convenience of the electrostatic speaker assembly is that, since the speaker structure is mounted entirely within the thickness of the tile, the speaker-tile assembly can be mounted flush to the ceiling or the wall surface using either mechanical fasteners or adhesives. As shown in FIG. 3, the magnetic speaker-tile assembly of FIG. 1, because of its greater depth or thickness, is suspended from a building superstructure 40 by means of support ties 42 and T-bars or hangers 44. The tile shoulders 46 and 48 rest on the T-bars.

FIG. 4 illustrates another means of interconnecting the speaker-tile assemblies. Here the tiles are in the form of two-superimposed rectangles. Looking at three sequential tiles, we see that the center tile 55 has a large rectangle 50 on top of a smaller rectangle 52, thereby forming outwardly extending shoulders 54 on the top of the tile. The two end tiles 56 and 58 each have a small rectangle 60 on top of a larger rectangle 62, thereby forming outwardly extending shoulders 64 on the bottom of the tile. Thus, when the speaker-tile assemblies are mounted in an array in a ceiling, the top shoulders 54 overlap the bottom shoulders 64 to form a flush ceiling surface.

FIG. 5 schematically illustrates the manner in which six adjoining loudspeaker-tile assemblies 70 can be connected in a series-parallel combination. More specifically, the electrical speaker elements 72 of the three upper assemblies are connected in a series circuit which is connected in parallel with the series-connected electrical speaker elements 74 of the three lower assemblies. In FIG. 6, the upper three speaker elements 72 are connected in a parallel circuit which is connected in series with the parallel-connected speaker elements 74 of the three lower assemblies.

FIG. 7 schematically illustrates the manner in which electrical terminals or contacts may be arranged on the speaker-tile assemblies in order to implement the series and parallel connections illustrated in FIGS. 5 and 6. Looking at the speaker-tile assembly 70*a*, for example, we see that its speaker element 72*a* is connected across a first pair of parallel contacts or terminals 76 mounted on one edge of the assembly and also across another pair of parallel contacts or terminals 78 mounted on the opposite edge of the assembly. Furthermore, the speaker element 72*a* is connected in series with series contacts or terminals 80 and 82 mounted on the other two opposite edges of the assembly. Thus, to connect speaker-tile assembly 70*a* in series with the speaker-tile assembly 70*b*, the series contact 82 of assembly 70*a* is merely electrically coupled to the series contact 80 of assembly 70*b*. Similarly, to connect speaker-tile assembly 70*a* in parallel with speaker-tile assembly 70*c*, the parallel contacts 78 of assembly 70*a* are merely electrically coupled to the parallel contacts 76 of assembly 70*c*.

Thus, by varying the physical orientation of the assemblies during installation, the overall impedance of the interconnected loudspeakers forming an array can be determined.

Figure 8B:
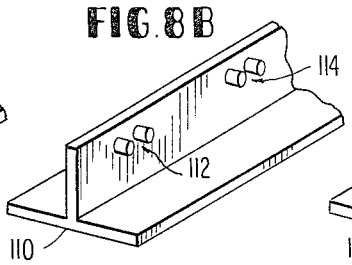
Figure 8C:
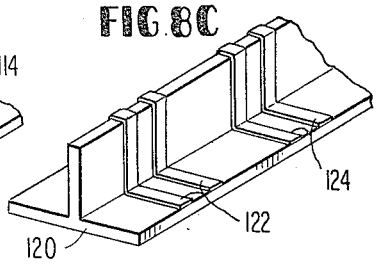

FIGS. 8A–8C illustrate various implementations or structures which permit the electrical interconnection of the speaker-tile assemblies in the simplest possible way without requiring soldering or inter-tile wiring during installation.

Figure 14:
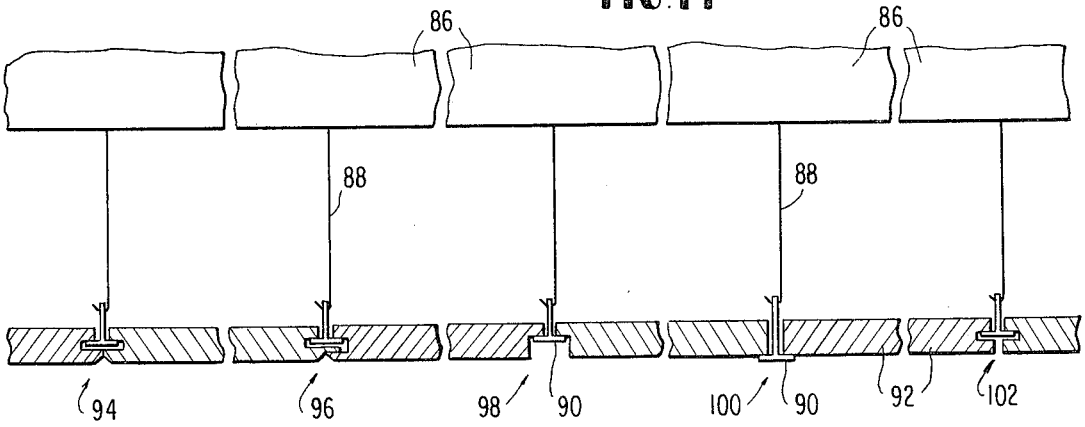
FIG. 14 illustrates a typical suspended ceiling structure into which the loudspeaker-tile assemblies of this invention can be incorporated.

First, FIG. 14 illustrates conventional methods for suspending acoustical tile from structural members to obtain a continuous or flush ceiling. Here, the structural members 86 hold support wires 88 to maintain the T-bars 90 at the same height above the floor. The acoustical tiles 92 are then supported on the T-bars in a well-known manner. Beginning from the left side of FIG. 14, these various mounting arrangements of the tiles can be identified as follows: 94: kerfed, rabbeted and beveled; 96: tongue-in-groove beveled; 98: recessed; 100: square T-bar; and 102: square, kerfed and rabbeted. As will be described below, the vertical hangars 88, which mechanically hold the T-bars in place, can also be used to feed electrical signals to the speaker in the array.

Returning to FIGS. 8A–8C, then, we see various electrical contact structures for supplying electrical signals via a T-bar to a speaker tile assembly. in FIG. 8A, the T-bar 104 has mounted thereon insulated electrically-conducting spring clips 106 and 108 which ae dimensioned to physically receive and electrically engage the electrical terminals or contacts 76, 78, 80 and 82 illustrated in FIG. 7, for example.

Figure 9A:
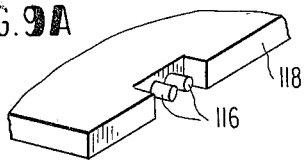
FIGS. 9A and 9B illustrate the manner in which terminals are arranged on the tiles to cooperate with the contacts on a T-bar for supplying operating power to the loudspeakers.

In FIG. 8B, the T-bar contains pairs of insulated contact pins 112 and 114 which are designed to mate with the corresponding contact pins 116 (only one pair of which is illustrated) of a tile 118 as shown in FIG. 9A, for example.

Figure 9B:
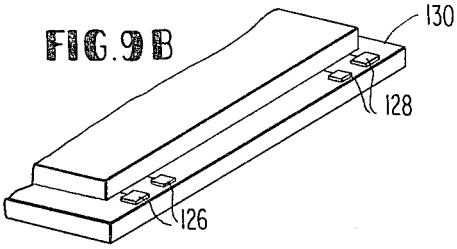

In FIG. 8C, the T-bar 120 contains pairs of insulated conducting foil strips 122 and 124 which are designed to mate with corresponding foil strips 126 and 128 on the tile 130 as illustrated in FIG. 9B, for example. These foil strips 126 and 128 may be secured to the tile by a mechanical fastener such as a staple or a nail, or, preferably, by conductive epoxy or grease. The plural pairs of contacts shown in FIGS. 8B, 8C, 9A, and 9B are illustrative of the provision of additional contact pairs and their associated conductors for use with other features and advantages of this invention, as desired, such as, for example, the microphone system of FIG. 15.

Figure 10:
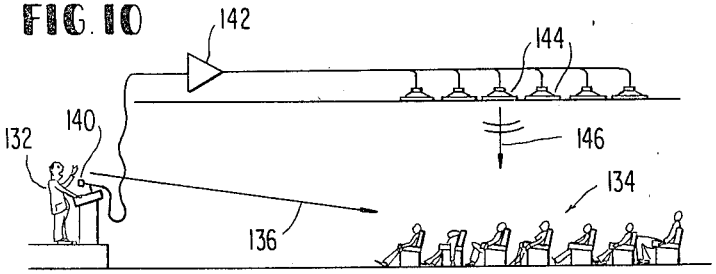
FIG. 10 is a schematic diagram illustrating the acoustical problem which arises when several speakers are used in a large room.
Figure 11:
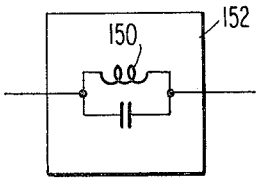
FIG. 11 illustrates a delay line mounted integrally in a ceiling tile for use in connection with a loudspeaker-tile assembly of this invention to provide an acoustical delay effect.

FIG. 10 illustrates a problem which arises when an array of speakers is used to amplify sound in a large auditorium or hallway when a person 132 addresses an audience 134. The person's voice travels directly through the air along the path 136 to the audience. However, the speaker's voice is also converted to electrical signals by the microphone 140, amplified by amplifier 142 and applied to the speakers 144 which radiate the sound towards the audience over the much-shorter acoustical path 146. Since the time involved in amplifying the electrical signals produced by the microphone 140 and then transmitting the sound along the shorter path 146 is less than the time required for the person's voice to reach the audience directly along the acoustical path 136, the audience hears the sound from the path 146 before the arrival of the sound from the acoustical path 136. This disparity in the arrival times of the two acoustical signals causes serious distortion. Therefore, it is desired to delay the sound produced by the electrical path to the speakers 144 so that the sound travelling over both paths 136 and 146 reaches the audience simultaneously. In order to accomplish this delay in accordance with this invention, delay lines or inductive-capacitive networks are employed so as to introduce different time delays. For example, as shown in FIG. 11, such a delay network 150 is built into a separate tile 152 which may be provided with electrical terminals or contacts similar to those illustrated in FIG. 7 to permit electrical interconnection of the delay element 170 with an adjacent speaker element. Alternatively, the element 170 can be electrically built into a speaker-tile assembly; with this arrangement, different time delays can be built into different loudspeaker-tile assemblies which then can be catalogued as zero-delay assemblies, short-delay assemblies, medium-delay assemblies and long-delay assemblies, depending upon the delay characteristic of the particular delay line.

Figure 12:
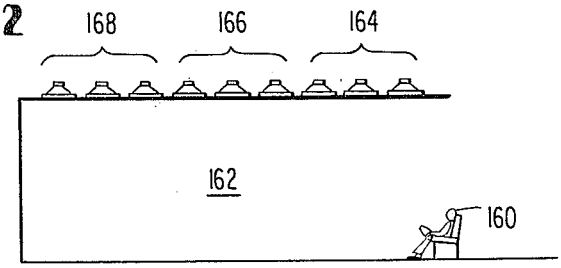
FIG. 12 schematically illustrates the manner in which delay lines may be used in a typical installation to provide a desired acoustical effect.

For example, as shown in FIG. 12, where a person 160 is sitting in a large room 162, speaker-tile assemblies hving different time delays may be arranged in an array to assure that the sound from all the speakers reaches the listener at the same time. For example, speakers 164 would have a long-delay, speakers 166 would have a medium-delay and speakers 168 would have a short-delay.

Figure 13:
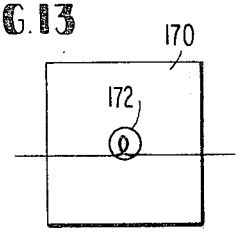
FIG. 13 illustrates a lamp mounted integrally in a ceiling tile for emitting light whose intensity is modulated by the electrical signals applied to a loudspeaker in the array.

FIG. 13 illustrates a tile 170 having an incandescent lamp 172 mounted integrally in the tile in place of a loudspeaker. The electrical signals are applied to the lamp 172 in the same manner as the signals are applied to a loudspeaker, whereby the intensity of the light emitted by the lamp is modulated in accordance with the electrical signals for such applications as color organs and discos, and also for decorative purposes. The lamp 172 may be incandescent, fluorescent, electroluminescent or stroboscopic.

FIG. 15 illustrates another embodiment of the invention wherein a speaker array is used for the playback of white noise for noise-masking applications in office buildings, for example. Here, a plurality of microphones 180 are mounted at the corners of an array of loudspeaker-tile assemblies 182. Each microphone is connected electrically to the four speaker-tile assemblies which surround it, and each speaker-tile assembly is connected to the four microphones at its corners. The sound energy detected by each microphone is amplified and fed out of phase to the four speaker-tile assemblies which are adjacent to it. Amplifiers can be built into the speaker-tiles, and if necessary, the frequency response can be adjusted to enhance the cancellation effect. Such an arrangement is an improvement over the conventional passive sound absorbers which are presently used to absorb undesired acoustical signals.

Furthermore, it should be noted that this invention does not depend on the particular type of loudspeaker used in the speaker-tile assembly. The loudspeaker can be of any type, such as magnetic, dynamic, electrostatic, piezoelectric, etc.

Furthermore, a large number of loudspeaker-tile assemblies mounted in either a vertical or horizontal array can be used to give an illusion of motion and direction when the loudspeakers are not all driven together, but rather are operated singly or in groups. For example, if many loudspeakers are mounted on a wall, and the music being reproduced by the loudspeakers was originally produced by an orchestra, those speakers corresponding in position to various instruments in the orchestra can be activated to give the illusion of the spatial distribution occupied originally by the orchestra. In another arrangement, where the speakers are formed in a vertical array on a wall, the left side can be interconnected in series-parallel to form a single integrated speaker system for one channel of a high fidelity system, and the right side, the other channel. In a more complex system, each vertical series of speakers can serve as the speaker for a single channel; thus, a single wall might have twenty or thirty speaker channels across its width.

I claim:

1. A loudspeaker assembly comprising:

a rectangular tile having a first pair of opposite edges and a second pair of opposite edges, and an outer surface and an inner surface;

a plurality of sound transmitting openings extending between said surface;

a loudspeaker having an active transducing element and secured to said inner surface to direct sound through said openings to said outer surface;

first electrical terminal means electrically connected in series with said active element and mounted on said first pair of opposite edges; and second electrical terminal means electrically connected in parallel with said active element and mounted on said second pair of opposite edges.

2. The assembly of claim 1 wherein said tile is an acoustical ceiling tile, and wherein said loudspeaker is integral with said tile.

3. The assembly of claim 2 wherein said loudspeaker is completely contained between said inner and outer surfaces of said tile.

4. A loudspeaker system comprising an array of loudspeaker assemblies each of which is defined in claim 1, and wherein the assemblies in the array are oriented so that respective ones of said first and second terminal means on different assemblies are adjacent each other for forming respective series and parallel connections between the active elements of adjacent assemblies.

5. The system of claim 4 wherein said array extends in the direction from a microphone to a listening area, and wherein each array contains at least one electrical delay line, the amount of delay imparted by each such delay line increasing in the direction toward the listening area, whereby the sound from all of the loudspeakers in the array reaches the listening area at substantially the same time.

6. The system of claim 4 further comprising a plurality of T-bars for suspending the assemblies from a ceiling, each T-bar having a vertical leg and a horizontal flange having flange portions projecting from opposite sides of said leg, and wherein the edges of the tiles rest on said flange portions, and conductive means on said flange portions for engaging said terminal means on a tile, whereby adjacent tiles are electrically connected via said conductive means.

7. The system of claim 6 wherein said conductive means are foil strips.

8. The system of claim 7 wherein said first and second terminal means are foil strips.

9. The system of claim 6 wherein said conductive means are pins.

10. The system of claim 9 wherein said first and second terminals are pins.

11. The assembly of claim 1 wherein said tile has a shoulder extending from said outer surface around the periphery of said tile.

12. The assembly of claim 1 wherein said tile has a shoulder extending from said inner surface around the periphery of said tile.

13. The assembly of claim 1 further comprising an electrical delay line connected to said active element.

14. The system of claim 4 further comprising an additional tile in said array and containing a lamp electrically connected to the active element of an adjacent loudspeaker assembly.

15. A loudspeaker assembly comprising a rectangular tile having at least two edges and an outer surface, a loudspeaker including an active transducing element, said loudspeaker being supported by said tile, said tile member being constructed and arranged to permit sound from said transducer and loudspeaker to emanate from said outer surface, and electrical connection means disposed on at least one of said edges for energization of said transducer, said edges of said tile being the support for said loudspeaker assembly.

* * * * *

UNITED STATES PATENT AND TRADEMARK OFFICE

CERTIFICATE OF CORRECTION

PATENT NO. : 4,330,691

DATED : May 18, 1982

INVENTOR(S) : Theodore J. Gordon

It is certified that error appears in the above—identified patent and that said Letters Patent is hereby corrected as shown below:

Column 1, lines 7 and 8, delete "loud speakers" and substitute therefor --loudspeakers--.

Column 4, lines 5-7, delete the colons and substitute therefor hyphens in their place, except for after the word "follows".

Column 4, line 10, delete "speaker" and substitute therefor --speakers--.

Column 4, line 13, delete "in" and substitute therefor --In--.

Column 4, line 15, delete "ae" and substitute therefor --are--.

Column 4, line 65, delete "the element" and substitute therefor --the delay element--.

Column 5, line 7, delete "hving" and substitute therefor --having--.

Column 5, line 68, delete "surface" and substitute therefor --surfaces--.

Signed and Sealed this

*Tenth* Day of *August 1982*

[SEAL]

*Attest:*

GERALD J. MOSSINGHOFF

*Attesting Officer* *Commissioner of Patents and Trademarks*